United States Patent [19]

Podkletnov, deceased et al.

[11] 4,068,621

[45] Jan. 17, 1978

[54] INSTALLATION FOR CONTINUOUS ENAMELLING OF PIPES

[76] Inventors: Evgeny Nikolaevich Podkletnov, deceased, late of Moscow, U.S.S.R. by Vera Matveevna Malkina; by Evgeny Evgenievich Podkletnov, administrators, both of Smolenksy bulvar, 6-8 kv. 144, Moscow, U.S.S.R.

[21] Appl. No.: 753,937

[22] Filed: Dec. 23, 1976

Related U.S. Application Data

[63] Continuation of Ser. No. 632,776, Nov. 17, 1975, abandoned, which is a continuation of Ser. No. 537,700, Dec. 31, 1974, abandoned.

[51] Int. Cl.[2] ..... B05C 5/00

[52] U.S. Cl. ..... 118/620; 118/DIG. 11; 118/314; 118/319

[58] Field of Search ..... 118/DIG. 10, DIG. 11, 118/DIG. 12, 58, 66, 314, 319, 425, DIG. 13, 620

[56] References Cited

U.S. PATENT DOCUMENTS

| | | | |
|---|---|---|---|
| 1,919,136 | 7/1933 | Smith | 118/DIG. 11 |
| 2,042,678 | 6/1936 | Miller | 118/DIG. 13 |
| 2,079,614 | 5/1937 | Holt et al. | 118/58 |
| 2,206,778 | 7/1940 | Kronquest | 118/58 X |
| 2,808,343 | 10/1957 | Simmons | 118/314 |

*Primary Examiner*—Dorsey Newton
*Attorney, Agent, or Firm*—Holman & Stern

[57] ABSTRACT

An installation for continuous two-sided enameling of pipes comprises a vertical receiving-and-discharging rotor a working rotor which moves pipes past working stations, and a mechanism for moving the pipes from one rotor to the other.

5 Claims, 2 Drawing Figures

INSTALLATION FOR CONTINUOUS ENAMELLING OF PIPES

This is a continuation of application Ser. No. 632,776, filed Nov. 17, 1975 which in turn is a continuation of U.S. Ser. No. 537,700, filed Dec. 31, 1974, both are now abandoned.

BACKGROUND OF THE INVENTION

The present invention relates to installations for continuous two-sided enameling of pipes, mainly large-diameter pipes.

Known in the art is an installation (see, for example, Austrian Pat. No. 267,279,) consisting of a number of successively mounted mechanisms for an enamel slip to a pipe surface and of heating appliances for drying and baking the enamel slip. The pipes to be enameled are conveyed in a horizontal position from one station to another by a conveying device.

The operations of applying and drying an enamel slip and its drying as well as the fusion of the enamel coating in the known installation are difficult because during these operations the pipes are conveyed horizontally and their outer surfaces rest on supports. For the same reason an effective enamel coating can be produced on the inner surface of pipes only while the outer surface can be given only a thin, decorative coating.

In addition, the known installation fails to ensure a closed working cycle so that the effective enamel coating (formed by one priming enamel coat and two covering layers of enamel) is obtained by passing the pipes three times through the installation which renders the installation low-productive and hinders its automation.

SUMMARY OF THE INVENTION

An object of the invention resides in eliminating the aforesaid disadvantages.

The present invention is intended to provide a more efficient installation for continuous enameling of pipes on a closed working cycle, ensuring the application of three enamel layers, and providing a conveying appliance allowing the two-sided enameling of pipes.

According to the invention, the present installation has a conveying appliance in the form of two vertical rotors installed side by side and provided with grips for holding pipes in a vertical position during their conveyance and treatment in which one rotor serves for receiving and discharging the pipes and the other rotor is a working rotor which moves the pipes past working stations, the installation comprising a mechanism for transferring the pipes from the receiving-and-discharging rotor to the working rotor and back.

It is practicable that the receiving-and-discharging rotor be installed near a conveyor for moving the pipes in a horizontal position, this conveyor being provided with a turn-over device which turns the pipes to the vertical position when transferring them to the receiving-and-discharging rotor and from the vertical position to the horizontal position while removing the pipes from this rotor.

The pipe grips of the working rotor should be mounted on carriages moving along vertical guides so as to allow the pipes to be manipulated at the working stations.

To facilitate manipulation of the pipes, each of them may be provided at one end with a removable head which allows the grips to hold the pipes in the vertical position.

It is preferable that the mechanism for transferring the vertically suspended pipes from one rotor to the other rotor should comprise a carriage located above the rotors and having a grip for holding the pipe by the head at the upper end, and another carriage located under the rotors and provided with a support for the lower end of the pipe.

An advantage of the invention resides first of all in that the vertical suspension of the pipes facilitates considerably the operations of applying the enamel slip, drying it, and baking the enamel coating.

Another advantage of the invention is the production of a two-sided effective enamel coating because the external surfaces of the pipes do not contact their supports in the course of the working process.

Still another advantage of the invention is the reduction of the path covered by the pipe during its enameling and, consequently, a higher output of the installation.

Among the other advantages of the invention are the small size of the installation, requiring smaller floor area, and a possibility of all-round automation of the enameling process.

BRIEF DESCRIPTION OF THE DRAWINGS

Now the invention will be described in detail by way of the preferred embodiment of the invention with reference to the accompanying drawings, in which.

DETAILED DESCRIPTION OF THE PREFERRED EMBODIMENT

Figure 1:
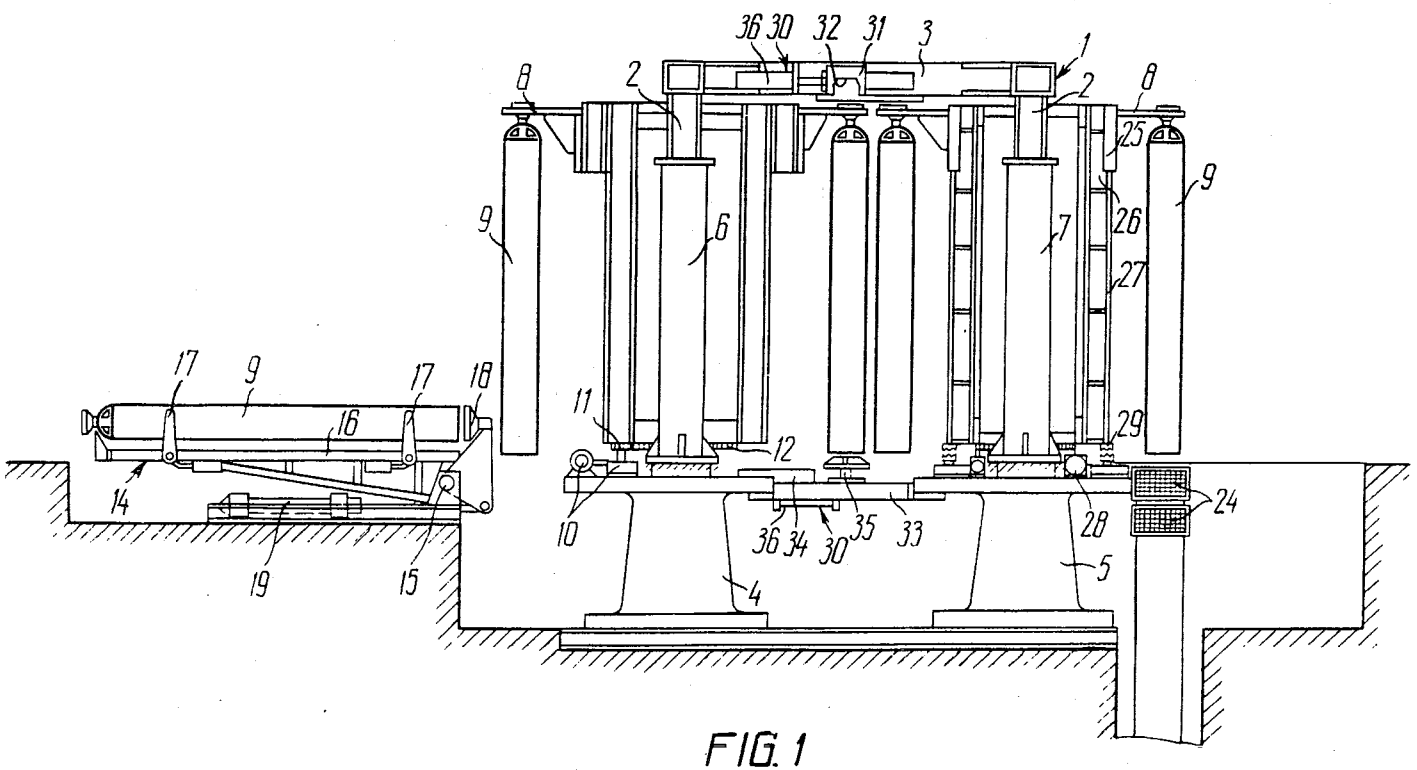
FIG. 1 is a side view of the installation according to the invention.
Figure 2:
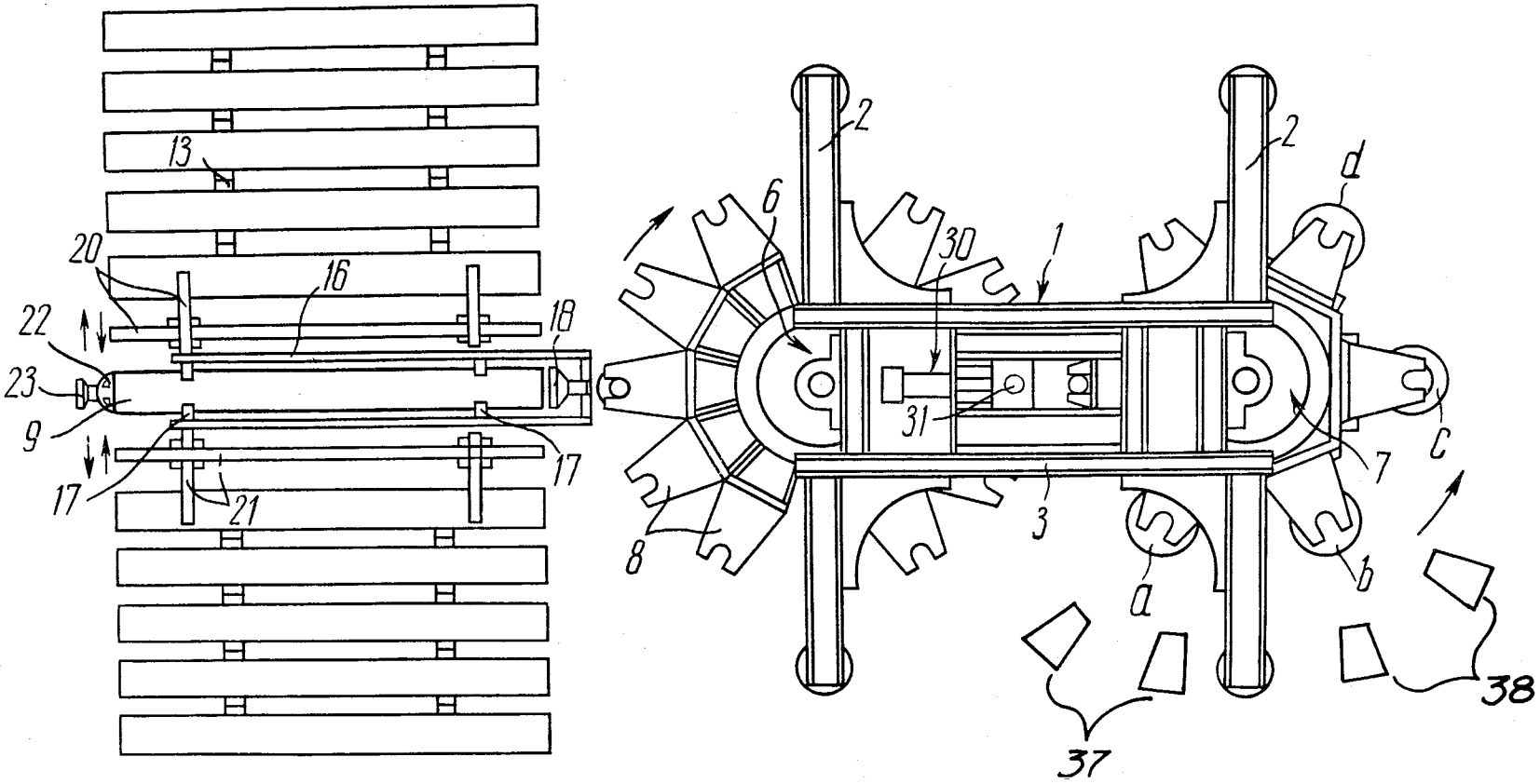
FIG. 2 is a top view of the same installation.

The present installation as illustrated in FIGS. 1 and 2 comprises a bed 1 formed by two vertical and parallel frames 2 interconnected by cross members 3.

The frames 2 mount vertical rotors 6 and 7 resting on bases 4 and 5, the rotors being provided with protruding fork-shaped grips 8 for holding pipes 9 during conveyances and treatment. The rotors 6 and 7 are rotated in opposite directions by drives 10 located on the bases 4 and 5, via a pair of gear wheels 11 and 12.

The rotor 6 is a receiving-and-discharging member and the number of its grips 8 is greater than that of the rotor 7. The rotor 6 is adjoined by a conveyor 13 for conveying the pipes 9 in a horizontal position.

Built into the conveyor 13 is a turn-over device 14 for shifting the pipes 9 from the horizontal position to the vertical position when transferring them to the receiving-and-discharging rotor 6 and from the vertical position to the horizontal position when removing the pipes from this rotor. The turn-over device 14 has the form of a cradle 16 turning around a pivot 15 and provided with side grips 17 and a support 18 for the lower end of the pipe. The cradle 16 is turned around the pivot 15 by a power cylinder 15.

For moving the pipes from the conveyor 13 onto the cradle 16 of the turn-over-device 14 and back, there are swivelling grips 20 and 21 built into the conveyor 13 and located before and after the turn-over device 14, respectively.

The grips 17 of the cradle 16 and the grips 20 and 21 may be of different designs; may be actuated by different appropriate means which can be easily understood by those skilled in the art. For example, they may take the form of one or two crescent-shaped levers controlled by a power cylinder (not shown).

Each pipe 9 delivered to the rotor 6 is provided with a removable head 22 at one end, the head having a mushroom projection 23 by which the pipe is held vertically by the grips 8 of the rotors 6 and 7. The head 22 is secured on the pipe with the aid of any suitable means and devices.

The rotor 7 is a working member; designed to move the pipes 9 past working stations *a, b, c* and *d* and on each of these stations. Installed on the working station "*a*" is a mechanism for applying the enamel slip (priming layer) to the pipe surfaces the mechanism may take the form of various sprayers 37 or a slip bath into which the pipe is dipped. Installed on the working station "*b*" is a mechanism for applying the enamel (second and third layers) in the form of sprayers 38 or a slip bath. Stations "*c*" and "*d*" are equipped with electric induction heaters 24 for drying and baking the enamel coating.

In view of the fact that the rotor 7 moves the pipes 9 at each working station, its grips 8, unlike those of the rotor 6, are secured on carriages 25 which are moved along vertical guides 26 of the rotor 7. For this purpose each carriage 25 is connected to a motion screw 27 (FIG. 1) operated by a variable-speed drive 28 via a disengaging clutch 29.

The pipes 9 are transferred from one rotor to the other by a mechanism 30 comprising a carriage 31 moved along the cross members 3 above the rotors 6 and 7, the carriage 31 having a grip 32 (similar to grips 17 or 20 and 21) for the pipes and a carriage 34 simultaneously moved along guides 33 between the bases 4 and 5 of the rotors 6 and 7, the carriage 34 having a support 35 for the lower end of the pipe. The support 35 can be moved vertically by a power cylinder (not shown). The carriages 31 and 34 are moved by synchronously operating cylinders 36.

The installation of the present invention functions as follows.

A pipe 9 cleaned previously by shot-blasting, sandblasting or any other method is delivered onto the conveyor 13 from which the grips 20 transfer it to the turnover device 14. Here a cylinder-pusher (not shown) applies pressure to the end of the pipe and moves the latter to the support 18. Then the turn-over device 14, holding the pipe 9 by the grips 17, turns it to the vertical position and inserts accurately inserts the pipe into the grip 8 of the rotor 6. When the rotor 6 becomes filled with pipes, the mechanism 30 transfers the pipes to the working rotor 7 for which purpose the support 35 moves together with the pipe inserting the projection 23 of the head 22 into the grip 32 after which the carriages 31 and 34 are moved too.

The rotor 7 moves with intervals which depend on the nature of the performed working operations. When the working rotor 7 becomes filled with the pipes, all the working operations at the stations *a, b, c* and *d* occur simultaneously and independently of one another.

While the slip coating is being baked at station "*d*", this coating is only dried at the preceding station "*c*" and is being applied at the foregoing station "*a*" or "*b*". These operations take place almost simultaneously. As these operations are completed, the rotor 7 turns, the pipe is transferred from station "*d*" to the rotor 6 for cooling, and its place is taken by the pipe with dried slip from station "*c*", the station "*c*" being occupied by the pipe coated with wet slip (primer or first covering layer) and transferred from station "*a*" or "*b*".

Thus, the process of enameling becomes continuous.

Having cooled on the rotor 6, the pipe is again transferred to the working rotor 7 and the process is repeated over again for obtaining a three-layer enamel coating.

The finished pipes are taken off the rotor 6 by the turn-over device 14 and conveyed by the conveyor 13 to the point of storage.

What is claimed is:

1. An apparatus for continuous enameling of pipes comprising: at least three working stations comprising in succession at least one working station including means for applying an enamel slip coating to at least one side of a pipe, at least one working station including means for drying the enamel slip coating and at least one working station including means for baking the enamel slip coating; two rotors mounted vertically side by side and provided with grips for holding pipes in a vertical position, one of the rotors serving to receive and discharge the pipes and the other of the rotors serving as a working rotor for moving the pipes along the at least three working stations disposed along the path of movement of the working rotor; means for transferring the pipes from the receiving and discharging rotor to the working rotor and from the working rotor to the receiving and discharging rotor; a conveyor means adjoining the receiving and discharging rotor for moving the pipes in a horizontal position and transferring the pipes thereto and therefrom, the conveyor means including a turnover device for shifting the pipes from the horizontal position to the vertical position as the pipes are transferred to the receiving and discharging rotor, and from the vertical position to the horizontal position as the pipes are transferred from the receiving and discharging rotor to the conveyor means.

2. The apparatus as claimed in claim 1, further comprising: carriages mounting the grips for holding the pipes on the working rotor; and vertical guides mounting the carriages and permitting movement of the carriages along the guides.

3. The apparatus as claimed in claim 1, wherein one end of each of the pipes is provided with a replaceable head for aiding the grips of the rotors in holding the pipes in the vertical position.

4. The apparatus as claimed in claim 3, wherein the means for transferring the pipes from one of the rotors to the other rotor comprises a first carriage located above the rotors and supporting a grip for holding a pipe by the replaceable head in the vertical position, and a second carriage supported at the base of the rotors and carrying means for supporting the lower end of a pipe.

5. An apparatus for continuous enameling of pipes comprising: at least three working stations comprising in succession at least one working station including means for applying an enamel slip coating to at least one side of a pipe, at least one working station including means for drying the enamel slip coating and at least one working station including means for baking the enamel slip coating; two rotors installed vertically side by side and provided with grips for holding pipes in a vertical position, one of the rotors serving to receive and discharge the pipes and the other of the rotors serving as a working rotor for moving the pipes along the at least three working stations disposed along the path of movement of the working rotor, the working rotor having vertical guides with carriages adapted to move therein and grips for holding the pipes in a vertical position; a conveyor means adjoining the receiving and discharging rotor for moving the pipes in a horizontal position; a turnover device associated with the conveyor means for shifting the pipes from the horizontal position to the vertical position as the pipes are transferred to the receiving and discharging rotor, and from the vertical position to the horizontal position as the pipes are discharged from the receiving and discharging rotor; a first carriage located above the rotors and supporting a grip for holding the pipes and a second carriage located at the base of the rotors and carrying a support against which the lower end of the pipes can bear, the first and second carriages comprising means for transferring the pipes from the receiving and discharging rotor to the working rotor and from the working rotor to the receiving and discharging rotor.

* * * * *